US012742329B2

(12) United States Patent
Sieder et al.

(10) Patent No.: US 12,742,329 B2
(45) Date of Patent: Sep. 22, 2026

(54) WALL OR FLOOR PANEL WITH LOCKING MEANS SUITABLE FOR HERRINGBONE-PATTERN INSTALLATION

(71) Applicant: SURFACE TECHNOLOGIES GMBH & CO. KG, Baruth (DE)

(72) Inventors: Andreas Sieder, Ludwigsfelde (DE); Hans-Jürgen Hannig, Bergisch Gladbach (DE)

(73) Assignee: SURFACE TECHNOLOGIES GMBH & CO. KG, Baruth (DE)

( * ) Notice: Subject to any disclaimer, the term of this patent is extended or adjusted under 35 U.S.C. 154(b) by 146 days.

(21) Appl. No.: 18/416,128

(22) Filed: Jan. 18, 2024

(65) Prior Publication Data

US 2024/0247497 A1 Jul. 25, 2024

(30) Foreign Application Priority Data

Jan. 20, 2023 (DE) ..... 202023100292.7

(51) Int. Cl.
*E04F 15/02* (2006.01)
*E04F 13/08* (2006.01)

(52) U.S. Cl.
CPC .... *E04F 15/02038* (2013.01); *E04F 13/0894* (2013.01); *E04F 2201/0146* (2013.01); *E04F 2201/0153* (2013.01); *E04F 2201/023* (2013.01); *E04F 2201/042* (2013.01); *E04F 2201/043* (2013.01); *E04F 2290/00* (2013.01)

(58) Field of Classification Search
CPC ..... E04F 15/02038; E04F 13/0894; E04F 2201/0146; E04F 2201/0153; E04F 2201/023; E04F 2201/042; E04F 2201/043; E04F 2290/00; E04F 2201/0138; E04F 2201/0161; E04F 2201/025; E04F 13/08; E04F 15/02
USPC ..... 52/578, 588.1, 589.1, 592.1, 590.2
See application file for complete search history.

(56) References Cited

U.S. PATENT DOCUMENTS

| | | | | |
|---|---|---|---|---|
| 10,808,410 | B2 * | 10/2020 | Boo | E04F 15/02033 |
| 11,624,193 | B2 * | 4/2023 | Boucké | B32B 27/40 52/309.17 |
| 11,639,605 | B2 * | 5/2023 | Boucké | E04F 13/18 52/588.1 |
| 2005/0138881 | A1 * | 6/2005 | Pervan | E04F 15/02 52/581 |
| 2005/0210810 | A1 * | 9/2005 | Pervan | E04F 15/02038 52/578 |
| 2007/0175156 | A1 * | 8/2007 | Pervan | E04F 15/02 52/582.1 |

(Continued)

FOREIGN PATENT DOCUMENTS

| | | |
|---|---|---|
| DE | 10 2004 028 757 A1 | 1/2006 |
| DE | 20 2019 101 603 U1 | 4/2019 |
| DE | 20 2019 103 690 U1 | 8/2019 |

(Continued)

OTHER PUBLICATIONS

Oct. 5, 2023 the Search Report issued in German Patent Application No. 20 2023 100 292.7.

*Primary Examiner* — Brent W Herring
(74) *Attorney, Agent, or Firm* — Harness, Dickey & Pierce, P.L.C.

(57) ABSTRACT

The present invention relates to a wall or floor panel with a locking arrangement suitable for herringbone-pattern installation.

11 Claims, 7 Drawing Sheets

(56) References Cited

U.S. PATENT DOCUMENTS

2009/0133353 A1* 5/2009 Pervan ..... H01F 7/122
52/747.1

FOREIGN PATENT DOCUMENTS

| | | | |
|---|---|---|---|
| EP | 3 907 348 | A1 | 11/2021 |
| WO | WO-1997/47843 | | 12/1997 |
| WO | WO-9747834 | A1 | 12/1997 |
| WO | WO-2005098163 | A1 | 10/2005 |
| WO | 2009080772 | A1 | 7/2009 |

* cited by examiner

WALL OR FLOOR PANEL WITH LOCKING MEANS SUITABLE FOR HERRINGBONE-PATTERN INSTALLATION

CROSS-REFERENCE TO RELATED APPLICATIONS

This application claims the benefit of German Application No. 202023100292.7, filed on Jan. 20, 2023. The entire disclosure of the application referenced above is incorporated herein by reference.

FIELD

The present disclosure relates to a wall or floor panel with locking means suitable for herringbone-pattern installation.

BACKGROUND

Wall or floor panels according to the disclosure are decorated sheets, slabs, or boards or decor panels and are known as such and are used, for example, in interior finishing as floor or wall coverings. The term wall panel also includes panels that are suitable as ceiling cladding. Usually, the panels consist of a carrier or core made of a solid material, for example a wood-based material, a plastic, or a composite material, which has provided on at least one side a decor layer, a cover layer, and possibly further layers, for example a wear layer arranged between the decor and cover layers. The decor layer is usually formed of a printed paper, or a decor printed directly onto the carrier or a decor base initially applied to the carrier. In recent years, in particular the so-called direct printing of decor onto a carrier or a decor base initially applied to the carrier using direct printing methods such as inkjet printing has gained increased importance in the relevant industry.

Methods for producing decor panels based on carriers made of wood-based materials such as HDF or MDF sheets are well known. For example, WO 2009/080772 discloses a method for producing a decorated laminate with a sheet-shaped core made of wood or a wood-based material.

Regardless of the chosen material of the carrier, the sheets obtained in this way are printed as large sheets several times the size of a final decor panel and then divided into individual, usually rectangular panels. The panels obtained in this way can then be provided with profiles on the panel edges, by means of which the individual decor panels can be joined to each other to form a connected surface.

In the field of classic parquet, so-called herringbone or ear of wheat patterns are known, in which periodically arranged parquet slats usually have a translational symmetry at right angles, 45° or 30° to the right angle.

To achieve such an installation pattern, both the long edges of a panel and the short edges of a panel need to be able to be connected to each other. In the field of classic parquet with simple groove/tongue profiles on the respective panel edges, this is easily possible, as the grooves provided on the long and short sides are compatible with the tongues provided on the respective other long or short side and not only can short or long sides be connected with each other but also short sides with long sides. However, connecting the panels with each other requires complex gluing to achieve a mechanically sound connection between the panels. For modern decor coverings, regardless of whether from the domain of real wood parquet or the domain of laminate panels or plastic panels, there is the requirement that they be able to be installed without any adhesive. Corresponding installation systems are known as click laminate or click parquet, for example.

However, with most of the adhesive-free locking systems used, the short edges and the long edges are only compatible with their own type, such that no connection can be made between a long edge and a short edge. However, this is necessary for the above-described herringbone-pattern installation. To realize this kind of installation, often different panel types are to be provided, which have different connecting means on their respective edges. However, such a provision of different panel types is logistically complex and, particularly in the do-it-yourself market, not desired.

From DE 20 2019 103 690, a panel is known that is rectangular and has long and short edges, with the panel comprising a coupling part at each long edge and at each short edge which allows the panel to be coupled with another such panel; wherein the coupling part at one long edge comprises a tongue and a downward-facing locking groove; wherein the coupling parts at the other long edge and at the short edges each comprise a groove and a locking lip; wherein the locking lip at each of the other long edge and the short edges limits the respective groove downwards and comprises an upward-facing locking element; wherein the tongue is configured to interact with the groove at each of the other long edge and the short edges of another such panel to effect a vertical locking between the respective edges; and wherein the downward-facing locking groove is configured to interact with the upward-facing locking element at each of the other long edge and the short edges of another such panel to effect a horizontal locking between the respective edges.

From WO 1997/47843, a panel is known in which the coupling part at one long edge is configured to interact with a coupling part at the other long edge of another such panel. The coupling part at one short edge is configured to interact with the coupling part at the other short edge of another such panel. The interacting coupling parts form a locking tongue-and-groove connection at both the long and the short edges. This is a tongue-and-groove connection that not only effects a vertical but also a horizontal locking between the coupled edges. The vertical locking is effected by the interaction between the tongue and the groove. The horizontal locking is obtained by a locking lip engaging a downward-facing locking groove.

The document WO 2005/098163 describes panels, of which only one type is necessary to obtain a herringbone pattern. In the coupled state the coupling parts at the long edges form a locking tongue-and-groove connection. The coupling parts at the short edges are identically designed and are configured to interact with each of the coupling parts at the long edges. However, the practical examples of the coupling parts at the short edges are quite complex or do not provide adequate locking. For example, the vertical movement of the short edges in the coupled state is not always limited. This has the disadvantageous result that a risk of height differences arises.

The solutions known in the prior art often exhibit the disadvantage of insufficient mechanical stability of the panel connections such that these loosen under load.

Therefore, the object of the present disclosure is to provide an improved wall or floor panel with which geometrically complex installation patterns such as, in particular, herringbone patterns can be easily provided without the need for providing different panel types.

This object is achieved by the wall or floor panel according to claim 1. Configurations of such a decor panel can be found in the dependent claims and the following description.

Thus, a wall or floor panel is proposed, having two opposite long edges and two opposite short edges, wherein the panel, at each long edge and at each short edge, has at least one connecting means that allows the panel to be connected to another panel at each other's long edges or at the long edges and the short edges. At one of the long edges, the connecting means includes a tongue and at least one downward-facing locking groove and one upward-facing locking groove as well as an upward-facing latching hook. At the other long edge, the connecting means has a latching hook and an essentially horizontal locking groove. At the short edges, the connecting means includes a tongue and at least one first downward-facing locking groove and one second downward-facing locking groove as well as a latching step. To connect the connecting means at one of the long edges with the connecting means at one of the other long edges, the downward-facing locking groove and the latching hook are shaped in such a way that, in the connected state of the connecting means, the latching hook engages the locking groove in a contact-locking manner between a distal groove surface and a proximal hook surface and the upward-facing latching hook of the locking element of the long edges supports itself via a head surface abutting a groove ceiling of the essentially horizontal groove of the locking element. To connect the connecting means at one of the long edges with the connecting means at the short edges, a tongue of the connecting element is shaped in such a way that, in the connected state of the connecting means, the tongue engages the downward-facing locking groove in a contact-locking manner between a proximal groove wall and a distal tongue surface and in a contact-locking manner between a proximal hook surface and a proximal tongue surface and in a contact-locking manner between a basal projection surface of a projection of the connecting element and an apical tongue surface of the tongue of the connecting element. To connect the connecting means at one of the long edges with the connecting means at the short edges, the tongue of the connecting element is shaped in such a way that, in the connected state of the connecting means, the apical tongue surface of the tongue is contact-locked to a basal projection surface of a proximal projection of the connecting element, a groove wall surface of the downward-facing locking groove is contact-locked to the proximal hook surface of the latching hook of the connecting element, and a base surface of a tongue base of the connecting element is contact-locked to an apical hook arm surface of the latching hook.

It has become apparent that with the wall or floor panel according to the disclosure, it is possible to provide geometrically complex installation patterns such as herringbone patterns in a simple and user-friendly manner even on large installation surfaces, which have an improved mechanical stability of the panel connections.

The term "decor panel" within the meaning of the disclosure refers, in particular, to wall, ceiling, door, or floor panels, which have a decor applied to a carrier sheet. Decor panels are used in a variety of ways both for the interior finishing of rooms and the decorative cladding of buildings, for example in exhibition stand construction. One of the most common areas of application for decor panels is their use as floor covering. Here, the decor panels often have a decor that is intended to imitate a decor template, usually a natural material.

Examples of such imitated natural materials are types of wood such as maple, oak, birch, cherry, ash, walnut, chestnut, wenge or exotic woods like panga panga, mahogany, bamboo, and bubinga. In addition, natural materials such as stone surfaces or ceramic surfaces are often imitated.

As carrier or core of a decor panel according to the disclosure, for example, a carrier based on a natural material, a plastic, a wood-plastic composite material, or a mineral-plastic composite material can be provided. Layered structures made of several of the mentioned materials can also be used, for example layered plasterboards or layered wood-plastic sheets.

For example, the carrier sheet or carrier can be formed of a thermoplastic, elastomeric, or thermosetting plastic. Also, slabs made of minerals such as natural and artificial stone slabs, concrete slabs, gypsum fiberboards, WPC sheets, SPC sheets as well as sheets made of natural raw materials such as cork and wood can be used as carriers according to the disclosure. Also, sheets made of biomass as a natural material such as straw, corn straw, bamboo, leaves, algae extracts, hemp, and oil palm fibers can be used according to the disclosure. Moreover, materials recycled from the mentioned materials can be used in the method according to the disclosure. Furthermore, the sheets can be based on the natural material cellulose, for example they can be made of paper or cardboard.

Wood-based materials within the meaning of the disclosure are not only solid-wood materials but also materials such as for example cross-laminated timber, glued laminated timber, blockboard, veneer plywood, laminated veneer lumber, parallel-strand lumber, and bending plywood. In addition to this, wood-based materials within the meaning of the disclosure also include wood chip materials such as chipboard, extruded particle boards, coarse chipboards, and laminated strand lumber as well as wood fiber materials such as wood-fiber insulation boards, medium-hard and hard fiberboards, and, in particular, medium-density fiberboards and high-density fiberboards. Also, wood-based materials within the meaning of the disclosure include modern wood-based materials such as wood-polymer materials, sandwich panels made of a light core material, such as foam, rigid foam, or paper honeycombs, and a layer of wood applied thereon, as well as mineral-bonded, for example using cement, woodchip boards. Cork also represents a wood-based material within the meaning of the disclosure.

Within the meaning of the disclosure, the term "fiber material" refers to materials such as paper and nonwoven fabric based on plant, animal, mineral, or artificial fibers, as well as cardboard. Examples of fiber materials made from plant fibers include not only paper and nonwoven fabric made from pulp fibers but also sheets made from biomass such as straw, corn straw, bamboo, leaves, algae extracts, hemp, cotton, or oil palm fibers. Examples of animal fiber materials include keratin-based materials such as wool or horsehair. Examples of mineral fiber materials include materials made from mineral wool or glass wool.

Furthermore, the carrier can be a plastic-based carrier, i.e. have a plastic or consist of one. Examples of thermoplastic plastics include polyvinyl chloride, polyolefins, polypropylene), polyamides, polyurethanes, polystyrene, acrylonitrile butadiene styrene, polymethyl methacrylate, polycarbonate, polyethylene terephthalate, polyether ether ketone, or mixtures or copolymers of these. The plastics may contain common fillers, for example a layered silicate such as talc, calcium carbonate, aluminum oxide, silica gel, quartz powder, wood flour, gypsum. They may also be dyed in a known manner. In particular, the design may include that the carrier material has a flame retardant.

In particular, thermoplastic plastics also have the advantage that the products made from them can be easily recycled. Recycled materials from other sources may also be used. This results in another way to reduce manufacturing costs.

According to a configuration of the wall or floor panel according to the disclosure, in the connected state of the connecting means of a short edge with a connecting means of a long edge, a contact-free space may be formed between the distal end face of the upward-facing latching hook and the proximal wall surface of the connecting element.

Within the meaning of the disclosure, a contact-free space refers to the absence of any direct contact between corresponding structural elements of the locking means. The corresponding structural elements therefore do not touch each other in the corresponding areas.

According to a further embodiment of the disclosure, in the connected state of the connecting means of a short edge with a connecting means of a long edge, a groove chamber may be formed between the undercut surface and the proximal groove wall of the upward-facing locking groove.

According to a further embodiment of the disclosure, in the connected state of the connecting means of a short edge with a connecting means of a long edge, a contact-free space may be formed between the groove ceiling of the downward-facing groove of the connecting element of the short edge and an apical hook surface of the latching hook of the connecting means of the long edge.

In a further alternative embodiment of the disclosure, the wall or floor panel according to any of the preceding claims may be provided, wherein, in the connected state of the connecting means of a long edge with a connecting means of a second compatible long edge, a contact-free space is formed between a proximal groove wall of the locking groove of the connecting means of the other long edge and the distal end face of the connecting means of the first long edge.

In a further embodiment of the disclosure, in the connected state of the connecting means of a first long edge with a connecting means of a second compatible long edge, a contact-free space may be formed between a groove ceiling of the locking groove of the connecting means of the second long edge and the apical hook surface of the latching hook of the connecting means of the first long edge.

In a further embodiment of the disclosure, in the connected state of the connecting means of a long edge with a connecting means of a second compatible long edge, a contact-free space may be formed between a proximal groove wall of the horizontal locking groove of the connecting means of the first long edge and the distal end face of the upward-facing latching hook of the connecting means of the second long edge. Here, the contact-free space may extend at least partially along the apical hook arm surface of the hook arm of the connecting means of the first long edge.

According to a preferred embodiment of the disclosure, the latching step of the connecting means at the short edges may be inclined towards the distal tongue surface of the connecting means. Within the meaning of the disclosure, "inclined" refers to the outer distal corner of the latching step being displaced in the distal direction relative to a plane of the proximal wall surface of the downward-facing locking groove and not being located in the plane of the proximal wall surface. Such inclination is preferably essentially arc-shaped.

According to a further embodiment of the disclosure, the connecting means of a first long edge may be able to be locked with the connecting means of a second compatible long edge by means of a pivoting movement. The connecting means of the first edge is thus swiveled into the connecting means of the second edge.

According to a further embodiment of the disclosure, the connecting means of the short edges may be able to be connected or locked with the connecting means of the long edges by means of an essentially vertical joining movement. Here, a substantially vertical force may be exerted in the direction of the installation substrate for the final connection or final locking of the two panel edges with each other. Such joining movements are generally known as push-to-lock.

BRIEF DESCRIPTION OF DRAWINGS

The disclosure will be explained in more detail with reference to figures.

FIG. 15 11 shows a connection of a connecting means according to FIG. 6 of a long edge with a connecting means of a short edge according to FIG. 3 in the connected state;

DETAILED DESCRIPTION

Figure 1:
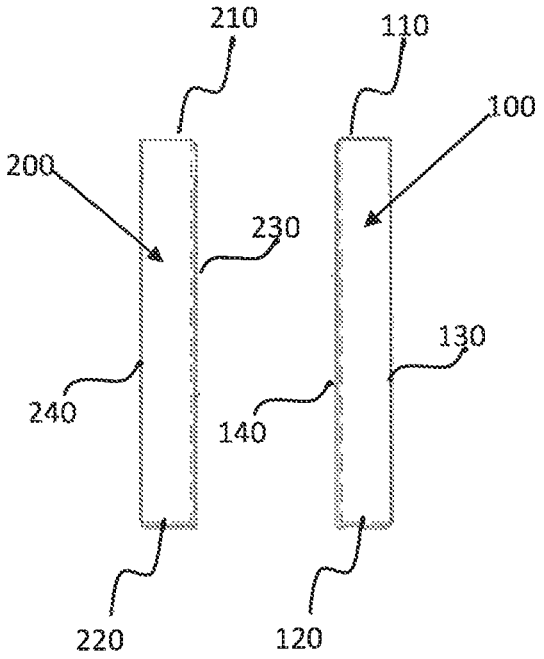
FIG. 1 illustrates panels with a corresponding assignment of the panel edges according to the disclosure.

FIG. 1 shows panels 100, 200 according to the disclosure with a corresponding mapping of the panel edges 110, 120, 210, 220 to the respective short edges of the panels 100, 200, and of the panel edges 130, 140, 230, 240 to the respective long edges of the panels 100, 200.

Figure 2:
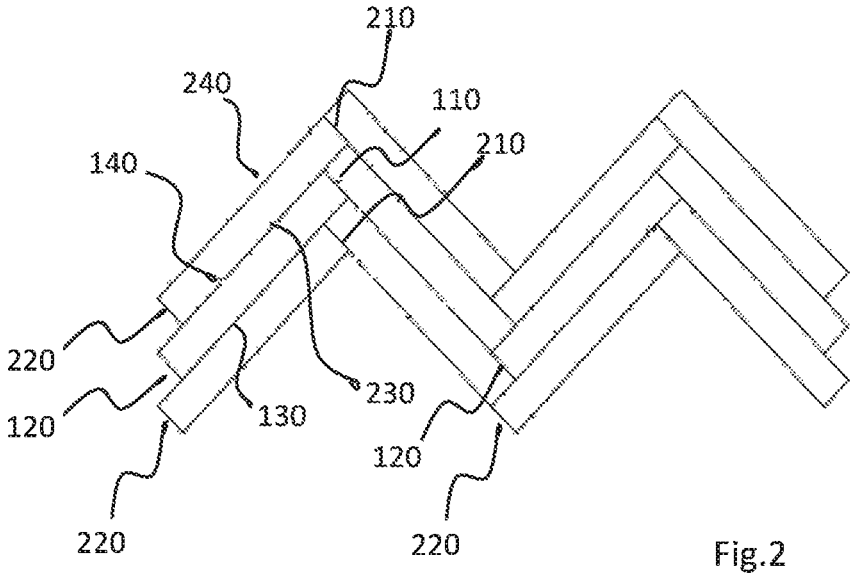
FIG. 2 illustrates a herringbone installation pattern to be achieved according to the disclosure.

FIG. 2 illustrates a herringbone installation pattern to be achieved according to the disclosure. Here, the panels 100, 200 are joined offset by 90° via the respective short edges 110, 120, 210, 220 being connected to the long edges 130, 140, 230, 240.

Figure 3:
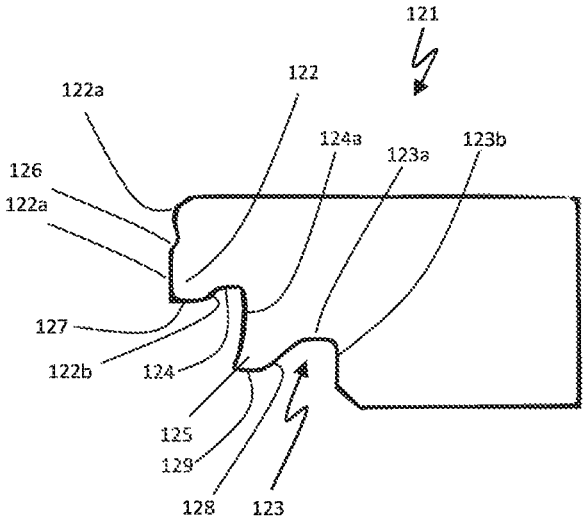
FIG. 3 shows a configuration of a connecting means at the short edges of a panel according to the disclosure.

FIG. 3 shows a configuration of a connecting means 121 at the short edges 110, 120, 210, 220 of a panel according to the disclosure. Here, the connecting means 121 has a tongue 122 with a distal tongue surface 122*a* and a proximal tongue surface 122*b*. Furthermore, the connecting element has a downward-facing locking groove 123 with a groove ceiling 123*a*, a proximal groove wall 123*b*, and a locking groove 124 with a proximal wall surface 124*a*. Also, the connecting element has a latching step 125 and an apical tongue surface 126, a tongue base 127, a groove wall surface 128, and a base surface 129 of the latching step 125.

Figure 4:
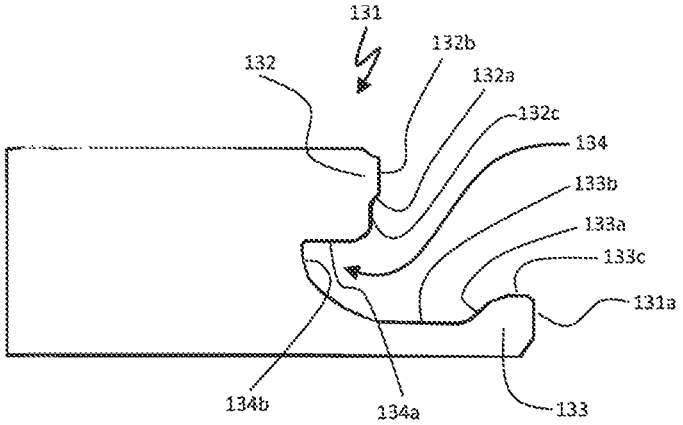
FIG. 4 shows a configuration of a connecting means at a first long edge according to the disclosure.

FIG. 4 shows a configuration of a connecting means 131 at a first long edge 130, 230 according to the disclosure. The connecting element 131 has a distal end face 131*a*, a proximal projection 132 with a basal projection surface 132*a*, a proximal end face 132*b*, and an undercut surface 132*c*. Furthermore, the connecting element 131 includes a latching hook 133 with a proximal hook surface 133*a*, an apical hook arm surface 133*b*, and an apical hook surface 133*c*. In addition, the connecting element includes a horizontal locking groove 134 with a groove ceiling 134*a* and a proximal groove wall 134*b*.

Figure 5:
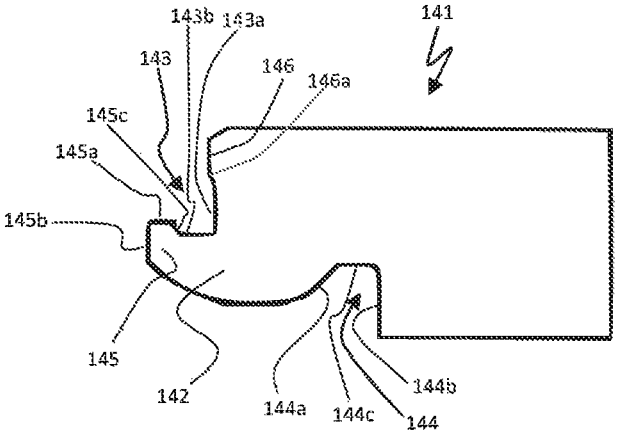
FIG. 5 shows a configuration of a connecting means at a second long edge according to the disclosure.

FIG. 5 shows a configuration of a connecting means 141 at a second long edge 140, 240 according to the disclosure. Here, the connecting means 141 has a tongue 142 with a distal tongue surface 142*a* and an upward-facing locking groove 143 with a proximal groove wall 143*a* and a groove floor 143*b*. Furthermore, the connecting element 141 has a locking groove 144 with a distal groove surface 144*a*, a proximal groove wall 144*b*, and a groove ceiling 144*c*. The connecting element 141 further includes an upward-facing latching hook 145 with a head surface 145*a*, a distal end face 145*b*, and a proximal hook surface 145*c*, as well as a projection 146 with a basal projection surface 146*a*. Furthermore, the connecting element 141 includes a tongue base 147, a groove wall surface 148, and a head surface 149.

Figure 6:
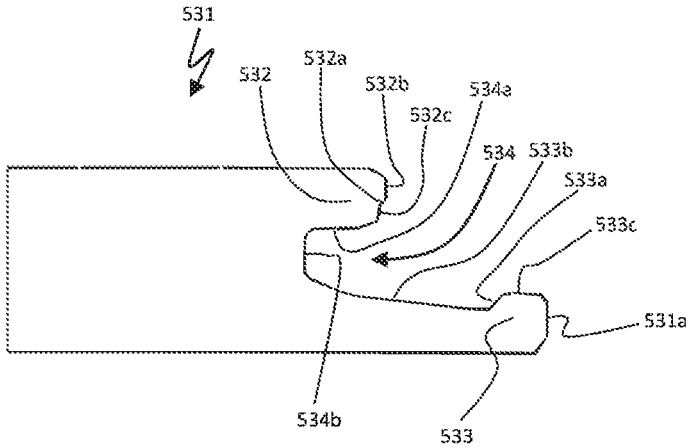
FIG. 6 shows an alternative configuration of a connecting means at a first long edge according to the disclosure.

FIG. 6 shows an alternative configuration of a connecting means 531 at a first long edge 130, 230 according to the disclosure. The connecting element 531 has a distal end face 531*a* and a proximal projection 532 with a basal projection surface 532*a*, a proximal end face 532*b*, and an undercut surface 532*c*. Furthermore, the connecting element 531 includes a latching hook 533 with a proximal hook surface 533*a*, an apical hook arm surface 533*b*, and an apical hook surface 533*c*. In addition, the connecting element includes a horizontal locking groove 534 with a groove ceiling 534*a* and a proximal groove wall 534*b*.

Figure 7:
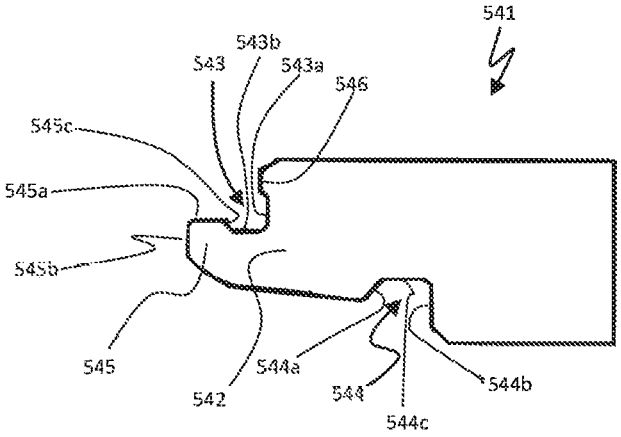
FIG. 7 shows an alternative configuration of a connecting means at a second long edge according to the disclosure.

FIG. 7 shows an alternative configuration of a connecting means 541 at a second long edge 140, 240 according to the disclosure. Here, the connecting means 541 has a tongue 542 with a distal tongue surface 542*a* and an upward-facing locking groove 543 with a proximal groove wall 543*a* and a groove floor 543*b*. Furthermore, the connecting element 541 has a locking groove 544 with a distal groove surface 144*a*, a proximal groove wall 544*b*, and a groove ceiling 544*c*. The connecting element 541 further includes an upward-facing latching hook 545 with a head surface 545*a*, a distal end face 545*b*, and a proximal hook surface 545*c*, as well as a projection 546 with a basal projection surface 546*a*. In addition, the connecting element 541 includes a tongue base 547, a groove wall surface 548, and a head surface 549.

Figure 8:
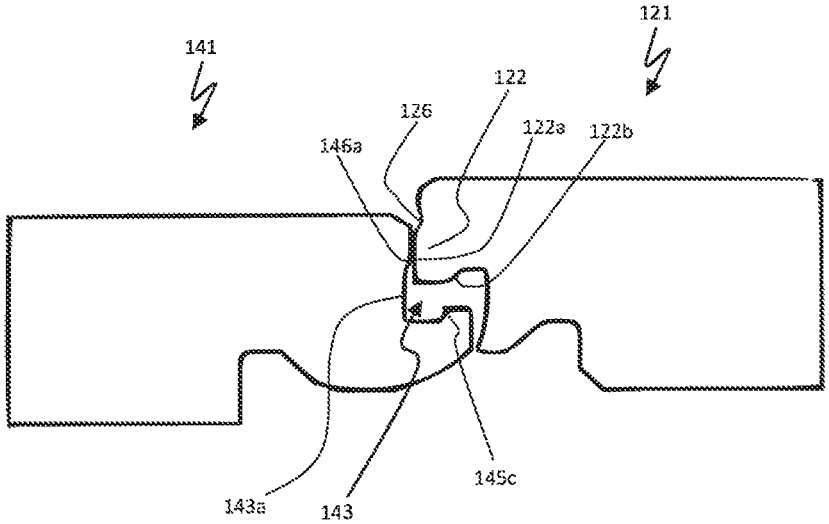
FIG. 8 shows a connection of a connecting means according to FIG. 5 of a long edge with a connecting means of a short edge according to FIG. 3 before the connecting means are finally connected.

FIG. 8 shows a connection of a connecting means 141 according to FIG. 5 of a long edge 140, 240 with a connecting means 121 of a short edge 110, 120, 210, 220 according to FIG. 3 before the connecting means are finally connected. To connect the connecting means 141 at one of the long edges 140, 240 with the connecting means 121 at the short edges 110, 120, 210, 220, the tongue 122 of the connecting element 121 is shaped in such a way that, in the connected state of the connecting means 121, 141, the tongue 122 engages the upward-facing locking groove 143 in a contact-locking manner between the proximal groove wall 143*a* and the distal tongue surface 122*a*, in a contact-locking manner between the proximal hook surface 145*c* and the proximal tongue surface 122*b*, and in a contact-locking manner between the basal projection surface 146*a* of the projection 146 of the connecting element 141 and the apical tongue surface 126 of the tongue 122 of the connecting element 121.

Figure 9:
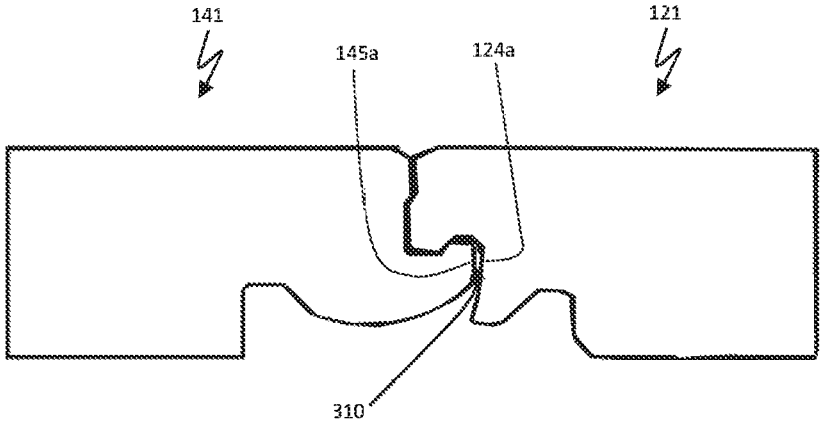
FIG. 9 shows the connection in FIG. 8 in the connected state.

FIG. 9 shows the connection in FIG. 8 in the connected state. Here, in the connected state of the connecting means 121 with a connecting means 141, a contact-free space 310 is formed between the distal end face 145*a* of the upward-facing latching hook 145 and the proximal wall surface 124*a* of the connecting element 121.

Figure 10:
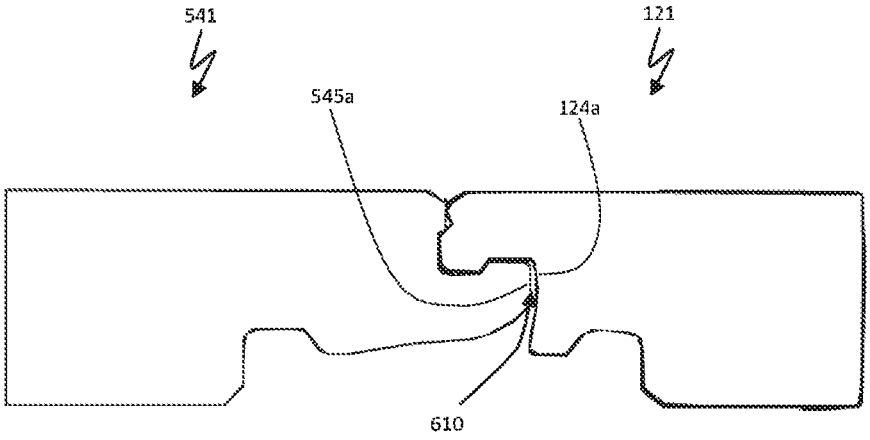
FIG. 10 shows a connection of an alternative configuration of a connecting means of a long edge according to FIG. 7 with a connecting means of a short edge according to FIG. 3 in the connected state.

FIG. 10 shows a connection of an alternative configuration of a connecting means 541 of a long edge according to FIG. 7 with the connecting means 121 of the short edges according to FIG. 3 in the connected state. Here, in the connected state of the connecting means 121 with a connecting means 541, a contact-free space 610 is formed between the distal end face 545*a* of the upward-facing latching hook 545 and the proximal wall surface 124*a* of the connecting element 121.

Figure 11:
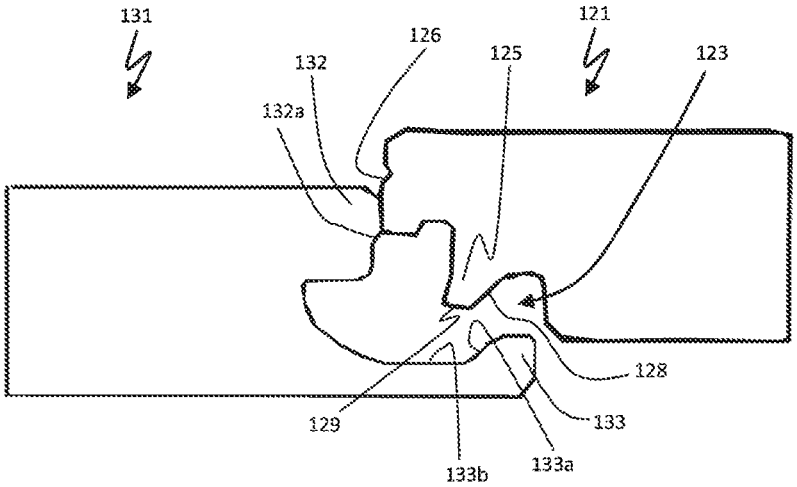
FIG. 11 shows a connection of a connecting means according to FIG. 4 of a long edge with a connecting means of a short edge according to FIG. 3 before the connecting means are finally connected.

FIG. 11 shows a connection of the connecting means 131 according to FIG. 4 of a long edge with the connecting means 121 of the short edges according to FIG. 3 before the connecting means are finally connected 131, 121. To connect the connecting means 131 with the connecting means 121 at the short edges, the tongue 122 of the connecting element 121 is shaped in such a way that, in the connected state of the connecting means 121, 131, the apical tongue surface 126 of the tongue 121 is contact-locked to the basal projection surface 132*a* of the proximal projection 132 of the connecting element 131, the groove wall surface 128 of the downward-facing locking groove 123 is contact-locked to the proximal hook surface 133*a* of the latching hook 133 of the connecting element 131, and the base surface 129 of the latching step 125 of the connecting element 121 is contact-locked to the apical hook arm surface 133*b* of the latching hook 133. Here, the connecting means 121 is able to be locked with the connecting means 131 by means of an essentially vertical joining movement.

Figure 12:
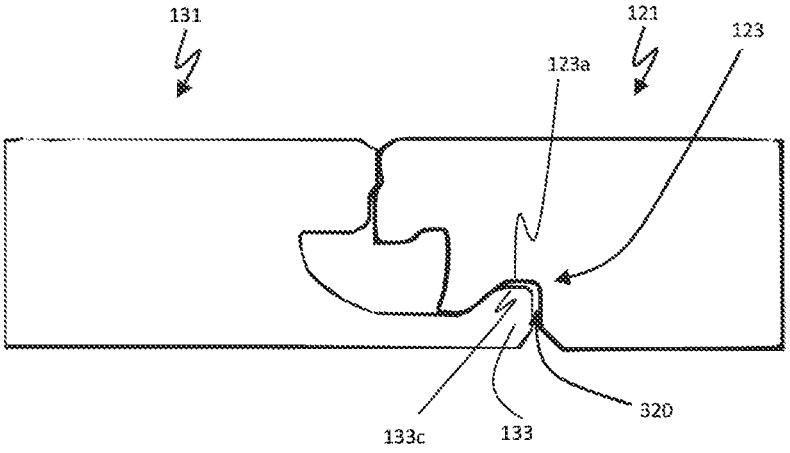
FIG. 12 shows the connection in FIG. 11 in the connected state.

FIG. 12 shows the connection in FIG. 11 in the connected state. In the connected state of the connecting means 121 with the connecting means 131, a contact-free space 320 is formed between the groove ceiling 123*a* of the downward-facing groove 123 of the connecting element 121 and the apical hook surface 133*c* of the latching hook 133.

Figure 13:
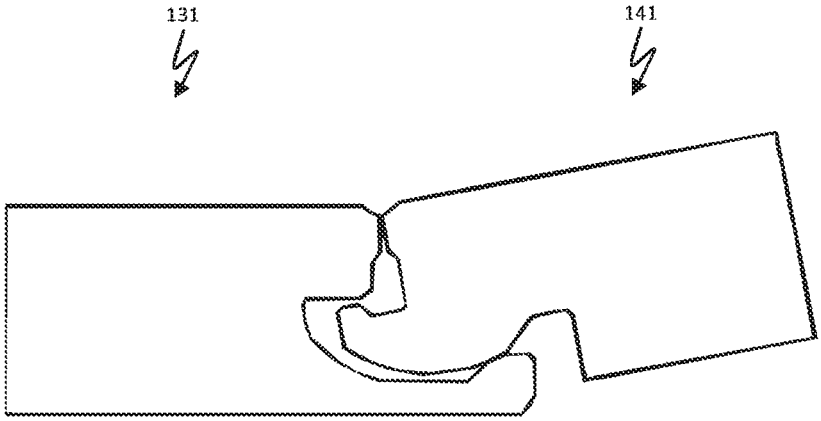
FIG. 13 shows a connection of a connecting means according to FIG. 4 of a long edge with a connecting means of a long edge according to FIG. 5 before the connecting means are finally connected.

FIG. 13 shows a connection of a connecting means 131 according to FIG. 4 of a long edge 130, 230 with the connecting means 141 of a compatible long edge 140, 240 according to FIG. 5 before the connecting means are finally connected 131, 141. Here, the connecting means 131 is able to be locked with the connecting means 141 by means of a pivoting movement.

Figure 14:
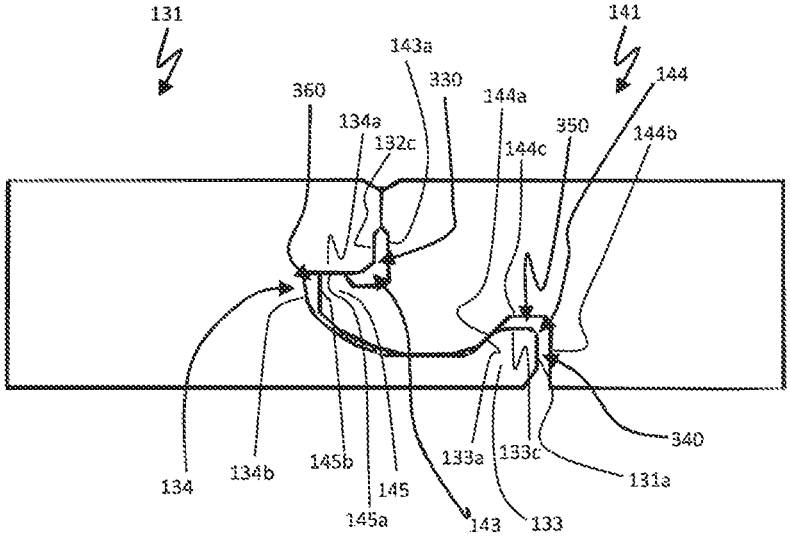
FIG. 14 shows the connection in FIG. 13 in the connected state.

FIG. 14 shows the connection in FIG. 13 in the connected state. To connect the connecting means 141 with the connecting means 131, the downward-facing locking groove 144 and the latching hook 133 are shaped in such a way that, in the connected state of the connecting means 131, 141, the latching hook 133 engages the locking groove 144 in a contact-locking manner between the distal groove surface 144*a* and the proximal hook surface 133*a* and the upward-facing latching hook 145 of the locking element 141 supports itself via the head surface 145*a* abutting a groove ceiling 134*a* of the essentially horizontal groove 134 of the locking element 131. In the connected state of the connecting means 131 with the connecting means 141, a contact-free space 340 is formed between the proximal groove wall 144*b* of the locking groove 144 and the distal end face 131*a* of the connecting means 131. Furthermore, a groove chamber 330 is formed between the undercut surface 132*c* and the proximal groove wall 143*a* of the upward-facing locking groove 143. Between the groove ceiling 144*c* of the locking groove 144 and the apical hook surface 133*c* of the latching hook 133 of the connecting means 131, a contact-free space 350 is formed in the connected state of the connecting means 131, 141. Between the proximal groove wall 134*b* of the horizontal locking groove 134 of the connecting means 131 and the distal end face 145*b* of the upward-facing latching hook 145 of the connecting means 141, a contact-free space 360 is also formed in the connected state of the connecting means 131, 141.

Figure 15:
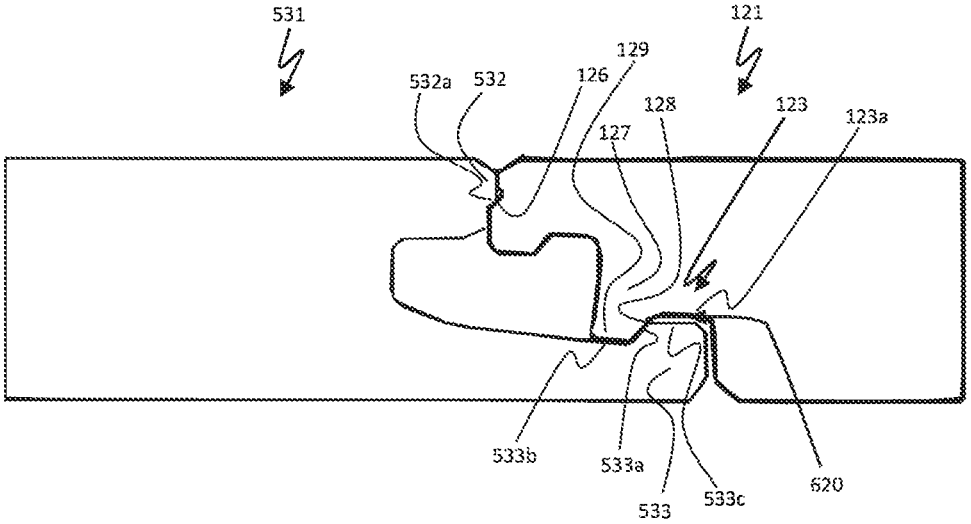

FIG. 15 shows a connection of a connecting means 531 according to FIG. 6 of a long edge with a connecting means 121 of a short edge according to FIG. 3 in the connected state. To connect the connecting means 531 with the connecting means 121 at the short edges, the tongue 122 of the connecting element 121 is shaped in such a way that, in the connected state of the connecting means 121, 531, the apical tongue surface 126 of the tongue 121 is contact-locked to the basal projection surface 532*a* of the proximal projection 532 of the connecting element 531, the groove wall surface 128 of the downward-facing locking groove 123 is contact-locked to the proximal hook surface 533*a* of the latching hook 533 of the connecting element 531, and the base surface 129 of the tongue base 127 of the connecting element 121 is contact-locked to the apical hook arm surface 533*b* of the latching hook 533. Here, the connecting means 121 is able to be locked with the connecting means 531 by means of an essentially vertical joining movement. In the connected state of the connecting means 121 with the connecting means 531, a contact-free space 620 is formed between the groove ceiling 123*a* of the downward-facing groove 123 of the connecting element 121 and the apical hook surface 533*c* of the latching hook 533.

Figure 16:
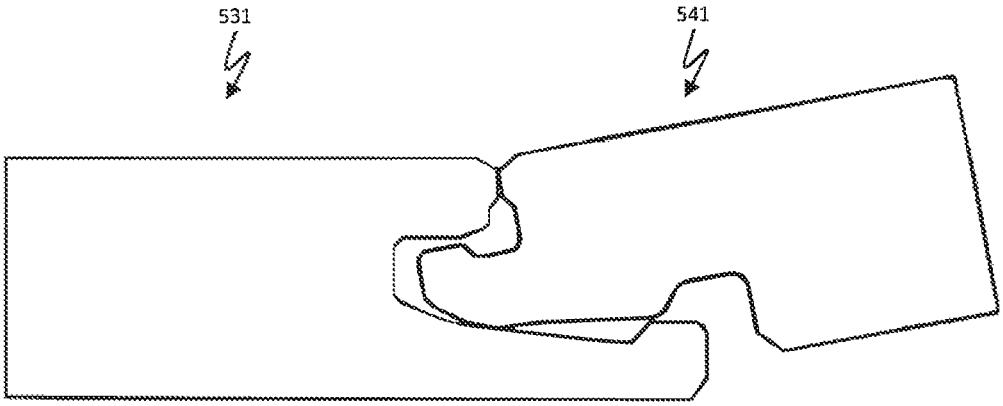
FIG. 16 shows a connection of a connecting means according to FIG. of a long edge with a connecting means of a long edge according to FIG. 7 before the connecting means are finally connected.

FIG. 16 shows a connection of a connecting means 531 according to FIG. 6 of a long edge 130, 230 with a connecting means 541 of a compatible long edge 140, 240 according to FIG. 7 before the connecting means are finally connected. Here, the connecting means 531 is able to be locked with the connecting means 541 by means of a pivoting movement.

Figure 17:
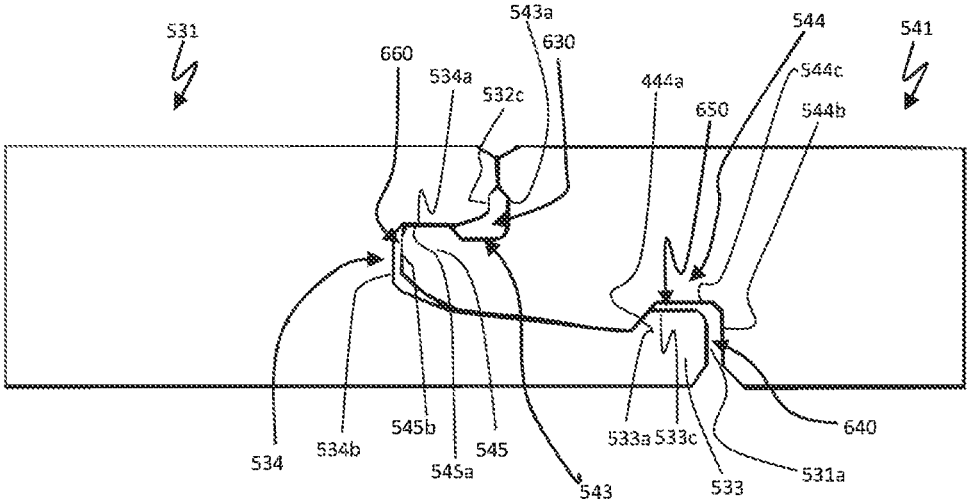
FIG. 17 shows the connection in FIG. 16 in the connected state.

FIG. 17 shows the connection in FIG. 16 in the connected state. To connect the connecting means 541 with the connecting means 531, the downward-facing locking groove 544 and the latching hook 533 are shaped in such a way that, in the connected state of the connecting means 531, 541, the latching hook 533 engages the locking groove 544 in a contact-locking manner between the distal groove surface 544*a* and the proximal hook surface 533*a* and the upward-facing latching hook 545 of the locking element 541 supports itself via the head surface 545*a* abutting a groove ceiling 534*a* of the essentially horizontal groove 534 of the locking element 531. In the connected state of the connecting means 531 with the connecting means 541, a contact-free space 640 is formed between the proximal groove wall 544*b* of the locking groove 544 and the distal end face 531*a* of the connecting means 531. Furthermore, a groove chamber 630 is formed between the undercut surface 532*c* and the proximal groove wall 543*a* of the upward-facing locking groove 543. Between the groove ceiling 544*c* of the locking groove 544 and the apical hook surface 531*c* of the latching hook 533 of the connecting means 531, a contact-free space 650 is formed in the connected state of the connecting means 531, 541. Between the proximal groove wall 534*b* of the horizontal locking groove 534 of the connecting means 531 and the distal end face 545*b* of the upward-facing latching hook 545 of the connecting means 541, a contact-free space 660 is also formed in the connected state of the connecting means 531, 541.

What is claimed is:

1. A wall or floor panel, each having two opposite long edges and two opposite short edges, wherein the panel, at each long edge and at each short edge, has at least one connecting means that allows the panel to be connected to another panel at each other's long edges or at the long edges and the short edges, wherein, at one of the long edges, a first connecting means includes a first tongue and at least one downward-facing locking groove and one upward-facing locking groove as well as an upward-facing latching hook; wherein, at the other long edge, a second connecting means has another latching hook and an essentially horizontal locking groove, and wherein, at the short edges, a third connecting means includes a second tongue and at least one first downward-facing locking groove and one second downward-facing locking groove as well as a latching step, wherein, to connect the first connecting means at one of the long edges with the second connecting means at one of the other long edges, the downward-facing locking groove of the first connecting means and the another latching hook are configured such that, in a connected state, the another latching hook engages the downward-facing locking groove of the first connecting means in a contact-locking manner between a distal groove surface and a proximal hook surface and the upward-facing latching hook of the first connecting means supports itself via a head surface abutting a groove ceiling of the essentially horizontal groove of the second connecting means; wherein, to connect the first connecting means at one of the long edges with the third connecting means at the short edges, the second tongue of the third connecting means is shaped such that, in the connected state, the second tongue engages the downward-facing locking groove of the first connecting means in a contact-locking manner between a proximal groove wall and a distal tongue surface, in a contact-locking manner between a proximal hook surface and a proximal tongue surface, and in a contact-locking manner between a basal projection surface of a projection of the first connecting means and an apical tongue surface of the second tongue of the third connecting means of the short edge;

and wherein, to connect the second connecting means at one of the long edges with the third connecting means at the short edges, the second tongue of the third connecting means on the short edge is shaped such that, in the connected state, the apical tongue surface of the second tongue is contact-locked to a basal projection surface of a proximal projection of the second connecting means, a groove wall surface of the second downward-facing locking groove is contact-locked to the proximal hook surface of the another latching hook of the second connecting means on the long edge, and a base surface of a tongue base of the third connecting means on the short edge is contact-locked to an apical hook arm surface of the another latching hook, the apical hook arm surface including a lower-most surface of the essentially horizontal locking groove.

2. The wall or floor panel according to claim 1, wherein, in the connected state of the third connecting means of a short edge with the first or second connecting means of a long edge, a contact-free space is formed between the distal end face of the upward-facing latching hook and the proximal wall surface of the connecting element.

3. The wall or floor panel according to claims 1, wherein, in the connected state of the third connecting means of a short edge with the first or second connecting means of a long edge, a groove chamber is formed between the undercut surface and the proximal groove wall of the upward-facing locking groove.

4. The wall or floor panel according to claim 1, wherein, in the connected state of the third connecting means of a short edge with the first or second connecting means of a long edge, a contact-free space is formed between the groove ceiling of the downward-facing groove of the connecting element and an apical hook surface of the another latching hook.

5. The wall or floor panel according to according to claim 1, wherein, in the first connected state of the first connecting means of a long edge with the second connecting means of a long edge, a contact-free space is formed between a proximal groove wall of the locking groove of the first connecting means and the distal end face of the second connecting means.

6. The wall or floor panel according to according to claim 1, wherein, in the connected state of the first connecting means of a long edge with the second connecting means of a long edge, a contact-free space is formed between a groove ceiling of the locking groove of the first connecting means and the apical hook surface of the another latching hook of the second connecting means.

7. The wall or floor panel according to claim 6, wherein, in the connected state of the first connecting means of a long edge with the second connecting means of a compatible long edge, a contact-free space is formed between a proximal groove wall of the horizontal locking groove of the second connecting means and the distal end face of the upward-facing latching hook of the first connecting means.

8. The wall or floor panel according to claim 7, wherein the contact-free space extends at least partially along the apical hook arm surface.

9. The wall or floor panel according to according to claim 1, wherein the latching step of the third connecting means at the short edges is inclined towards the distal tongue surface.

10. The wall or floor panel according to according to claim 1, wherein the first connecting means of the long edges is able to be locked with the second connecting means of the other long edges by means of a pivoting movement.

11. The wall or floor panel according to according to claim 1, wherein the third connecting means of the short edges is able to be locked with the first or second connecting means of the long edges by means of an essentially vertical joining movement.

* * * * *